US007951016B2

(12) United States Patent
Yamagishi et al.

(10) Patent No.: US 7,951,016 B2
(45) **Date of Patent: *May 31, 2011**

(54) MULTI-PIECE SOLID GOLF BALL

(75) Inventors: Hisashi Yamagishi, Chichibu (JP); Hiroshi Higuchi, Chichibu (JP); Yasushi Ichikawa, Chichibu (JP); Junji Hayashi, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/388,226

(22) Filed: Feb. 18, 2009

(65) Prior Publication Data

US 2009/0197701 A1 Aug. 6, 2009

Related U.S. Application Data

(63) Continuation of application No. 08/898,853, filed on Jul. 25, 1997, now Pat. No. 7,510,487, which is a continuation of application No. 08/661,778, filed on Jun. 13, 1996, now Pat. No. 5,688,595.

(30) Foreign Application Priority Data

Jun. 14, 1995 (JP) ..... 7-171520

(51) Int. Cl.
*A63B 37/06* (2006.01)

(52) U.S. Cl. ..... 473/376

(58) Field of Classification Search ..... 473/376, 473/373, 374

See application file for complete search history.

(56) References Cited

U.S. PATENT DOCUMENTS

| | | | | |
|---|---|---|---|---|
| 4,431,193 | A | | 2/1984 | Nesbitt |
| 4,625,964 | A | | 12/1986 | Yamada |
| 4,919,434 | A | | 4/1990 | Saito |
| 5,048,838 | A | | 9/1991 | Chikaraishi et al. |
| 5,068,151 | A | | 11/1991 | Nakamura |
| 5,184,828 | A | | 2/1993 | Kim et al. |
| 5,253,871 | A | * | 10/1993 | Viollaz ..... 473/374 |
| 5,273,286 | A | | 12/1993 | Sun |
| 5,439,227 | A | | 8/1995 | Egashira et al. |
| 5,452,898 | A | | 9/1995 | Yamaoishi et al. |
| 5,497,996 | A | | 3/1996 | Cadorniga |
| 5,516,110 | A | | 5/1996 | Yabuki et al. |
| 5,688,191 | A | * | 11/1997 | Cavallaro et al. ..... 473/373 |
| 5,688,595 | A | * | 11/1997 | Yamagishi et al. ..... 428/375 |
| 5,702,311 | A | | 12/1997 | Higuchi et al. |
| 5,733,205 | A | | 3/1998 | Higuchi et al. |
| 5,743,816 | A | | 4/1998 | Ohsumi et al. |

* cited by examiner

*Primary Examiner* — Raeann Trimiew
(74) *Attorney, Agent, or Firm* — Sughrue Mion, PLLC

(57) ABSTRACT

A multi-piece solid golf ball comprises a core having a 5 structure consisting of at least two layers and a cover on the core consisting of outer and inner cover layers. The outer cover layer has a Shore D hardness of 40-60 degrees. The inner cover layer has a Shore D hardness of up to 53 degrees and lower than that of the outer cover layer. The ball's carry is comparable to conventional solid golf balls and spin receptivity is approximate to wound golf balls while the ball is durable and offers pleasant feel.

21 Claims, 1 Drawing Sheet

MULTI-PIECE SOLID GOLF BALL

This application is a continuation of pending U.S. application Ser. No. 08/898,853 filed Jul. 25, 1997, which is a continuation of U.S. application Ser. No. 08/661,778 filed Jun. 13, 1996, now U.S. Pat. No. 5,688,595. This application also claims priority to JP 7-171520, filed Jun. 14, 1995. The entire disclosures of the prior applications are hereby incorporated herein by reference.

BACKGROUND OF THE INVENTION

1. Field of the Invention

This invention relates to a multi-piece solid golf ball having a structure of at least four layers which is improved in flying performance, hitting feel, controllability and durability.

2. Prior Art

Golf balls of the thread wound balata structure have been long favored by many professional golfers and skilled golfers. Wound golf balls are superior in feeling and controllability which are essential factors for skilled golfers. Because of their structure that is receptive to more spin, however, the wound golf balls are less controllable in flying distance under certain conditions. For example, when the ball is hit against the wind, it tends to fly sharply high, failing to travel a satisfactory carry. When the ball is hit into fair winds, it will travel a more distance than intended.

Recently, modern two-piece solid golf balls designed for adequate spin are considered acceptable by some skilled golfers. The absolute difference from the wound golf balls still resides in spin receptivity since the two-piece solid golf balls are characterized by a lower spin rate. As compared with the wound golf balls, the two-piece solid golf balls are superior with respect to the carry and improved in straight flight due to a low spin rate, but upon long iron shots requiring controllability, they tend to fly too much, indicating a loss of control. With respect to feel, the two-piece solid golf balls are approaching to the wound golf balls with room for improvement still left.

SUMMARY OF THE INVENTION

Therefore, a primary object of the present invention is to provide a multi-piece solid golf ball which will travel a satisfactory carry as inherent to solid golf balls when shot with a driver, receives more spin when shot with an iron, and has controllability closer to the wound balata golf ball.

The present invention provides a multi-piece solid golf ball having a structure of at least four layers, comprising a core having a structure consisting of at least two layers and a cover enclosing the core and consisting of inner and outer cover layers. The outer cover layer has a hardness of 40 to 60 degrees on Shore D. The inner cover layer has a hardness of up to 53 degrees on Shore D and lower than that of the outer cover layer.

DETAILED DESCRIPTION OF THE INVENTION

Figure 1:
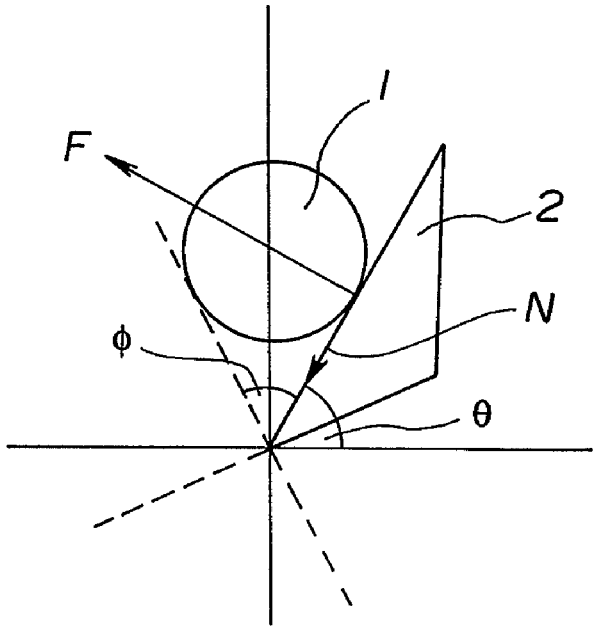
FIG. 1 schematically illustrates a club striking a ball.

It is now considered how the golf ball spins when hit by a club. The factors that determine spin include the loft of a club, the relation of an impact point to the center of gravity, and the head speed of the club. Since the latter two factors are correlated to the club configuration and the player's ability, it is now assumed that these factors are fixed. Only the club loft is now considered. A model diagram of a golf ball and a golf club upon impact is shown in FIG. 1. A golf ball 1 is hit by a golf club 2 having a static loft $\Phi$ and a dynamic impact loft $\theta$. F is a component of force perpendicular to the club face and N is a component of force parallel to the club face. The perpendicular component of force F and the parallel component of force N with respect to the club face have the relation: $F/N=\tan\theta$. Since the impact loft $\theta$ decreases as the club loft $\Phi$ increases, the value of $(F/N)_D$ associated with the use of a driver having a certain club loft is greater than the value of (F/N) associated with the use of a club having a larger club loft, typically $(F/N)_{SW}$ associated with the use of a sand wedge, that is, $(F/N)_D>(F/N)_{SW}$.

The ball is deformed by the force F perpendicular to the club face and spun by the force N parallel to the club face. Since a two-piece solid golf ball restitutes from the deformation at a higher rate as compared with the wound golf ball, the ball leaves the club face before a sufficient spin is imparted. This is generally known as a slip phenomenon which accounts for the poor spin receptivity of the conventional two-piece solid golf ball as compared with the wound golf ball.

To produce a spin sufficient for adequate control, a frictional force must act between the golf ball and the club face. This requires to use a relatively soft cover material. Nevertheless, the conventional solid golf balls cannot fully suppress the above-mentioned slip phenomenon.

As defined above, the golf ball of the invention uses a two-layer cover wherein the outer cover layer has a hardness of 40 to 60 degrees on Shore D and the inner cover layer has a hardness of up to 53 degrees on Shore D and lower than that of the outer cover layer. Differently stated, inside a soft outer cover layer is formed a softer inner cover layer. This is one of the features of the invention. With the ball wherein the inner cover layer which is softer than the outer cover layer lies inside the outer cover layer which is soft in itself is subject to a driver shot providing a great value of F/N indicating that the perpendicular force F is greater than the parallel force N, a compressive force acts on the inner cover layer to a greater extent and a force in a shearing direction is smaller than the compressive force. Since soft layers are provided in the compression direction, the feel upon hitting is very soft and comparable to the feel of the wound balata golf ball. In addition, since the force in the shearing direction is small, the reaction force at the same site is small enough to restrain too much spinning. This ensures a low spin, flat and long-extending ball trajectory and carry that solid golf balls inherently possess.

On the other hand, when a club having a greater loft is used, the force in a shearing direction increases relative to the compressive force. Since the inner cover layer is formed as a softer layer, the amount of local deformation in a shearing direction increases in response to the shearing force. This restrains the slip phenomenon which is the drawback of solid golf balls. The resultant spin performance is approximate to that of the wound golf ball rather than the prior art solid golf balls designed in pursuit of spin performance. Thus the ball can respond to an intentional shot.

In addition to the structure that the cover consists of two layers, the golf ball of the invention is structured as consisting of at least four layers since the core consists of at least two layers. The ball thus has improved restitution or repulsion. More particularly, the use of a soft material as a ball component generally tends to lower restitution to reduce carry. By forming the core as a multi-layer structure having two or more layers, restitution is improved due to the embracement effect of the respective layers as compared with a single layer structure core of the same softness, ensuring a satisfactory carry. The multi layer core consisting of an inner sphere and a layer surrounding the inner sphere wherein the inner sphere is formed softer than the surrounding layer is improved in hitting feel or affords a softer hitting feel.

As mentioned above, the golf ball comprising at least four layers wherein the cover has a two layer structure consisting of a soft outer cover layer and a softer inner cover layer provides spin performance approximate to that of the wound golf ball rather than the prior art solid golf balls designed in pursuit of spin performance while maintaining the flying performance inherent to solid golf balls. That is, there is obtained a golf ball which has advantages of solid golf balls and wound golf balls.

Therefore, a multi-piece solid golf ball is defined according to the present invention as comprising a core having a structure consisting of at least two layers and a cover enclosing the core and consisting of inner and outer cover layers, the outer cover layer having a Shore D hardness of 40 to 60 degrees, and the inner cover layer having a Shore D hardness of up to 53 degrees and lower than that of the outer cover layer.

Figure 2:
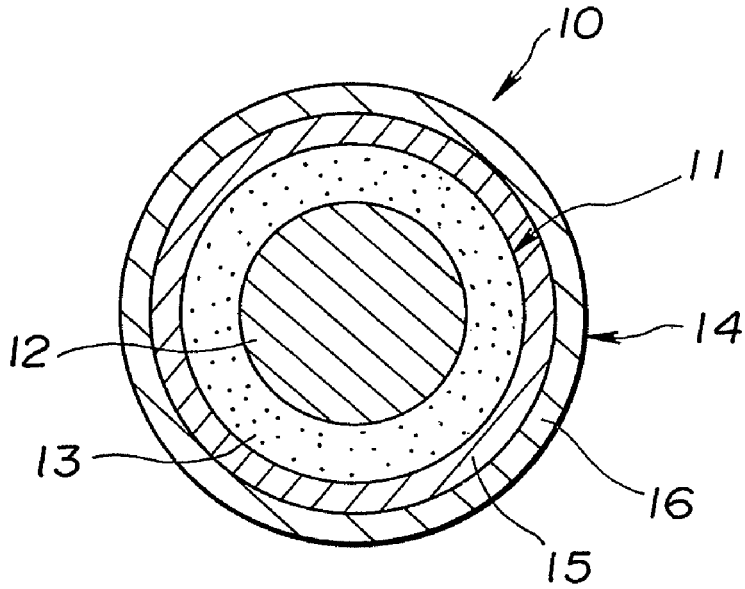
FIG. 2 is a schematic cross section of one exemplary multi-piece solid golf ball according to the invention.

Referring to FIG. 2, there is illustrated one exemplary structure of the golf ball according to the invention. The ball generally designated at 10 includes a solid core 11 consisting of an inner sphere 12 and a layer 13 surrounding the inner sphere and a cover 14 around the core consisting of inner and outer cover layers 15 and 16. The surrounding layer 13 may be a single layer or have a plurality of layers. In the former case, the golf ball is of the four layer structure.

The outer cover layer 16 is formed to a hardness of 40 to 60 degrees, preferably 40 to 58 degrees on Shore D. With a hardness of less than 40 degrees, the ball is reduced in restitution, failing to provide satisfactory flying performance. With a hardness of more than 60 degrees, the frictional force between the golf ball and the club face is reduced to induce the so-called slip phenomenon, failing to provide sufficient controllability. The inner cover layer 15 has a hardness of up to 53 degrees, preferably up to 50 degrees on Shore D. If the inner cover layer hardness exceeds 53 degrees, the amount of local deformation in a shearing direction can be reduced to induce the slip phenomenon when a club having a greater loft is used. The inner cover layer 15 should preferably have a hardness of at least 30 degrees on Shore D in order to provide restitution for the ball.

The inner cover layer 15 should be formed softer than the outer cover layer 16. The objects of the invention are not achieved if the inner cover layer. 15 is harder than the outer cover layer 16. It is recommended for the objects of the invention that the inner cover layer is softer than the outer cover layer by a hardness difference of at least 5 degrees, more preferably 5 to 30 degrees, most preferably 5 to 20 degrees on Shore D.

Preferably the outer cover layer 16 has a gage (or radial thickness) of 0.5 to 3.0 mm, especially 1.0 to 2.3 mm, the inner cover layer 15 has a gage of 0.5 to 3.0 mm, especially 1.0 to 2.0 mm, and the entire cover 14 has a gage 15 of 1.0 to 5.0 mm, especially 2.0 to 4.0 mm. If the outer cover layer 16 is too thin, the ball would be less durable. If the outer cover layer 16 is too thick, restitution would be lost. If the inner cover layer 15 is too thin, the local deformation in a shearing direction would be reduced, failing to suppress the slip phenomenon. If the inner cover layer 15 is too thick, restitution would be lost. If the entire cover 14 is too thin, the ball would be less durable and poor in feel. If the entire cover 14 is too thick, the ball would lose restitution, failing to provide satisfactory flying performance.

The inner and outer cover layers 15 and 16 may be formed to the above-defined hardness using thermoplastic resins such as ionomer resins and non-ionomer resins alone or in admixture.

In the core 11, the inner sphere 12 preferably has a Shore D hardness of 20 to 55 degrees, especially 25 to 50 degrees and a distortion of 2.6 to 8.7 mm, especially 3.5 to 7.7 mm under a load of 100 kg. If the inner sphere 12 has a hardness that is too low, restitution would be lost, failing to provide satisfactory flying performance. If the inner sphere 12 has a hardness that is too high, the feel would be exacerbated. The inner sphere 12 should preferably have a diameter of 20 to 39 mm, especially 25 to 38 mm since it has a substantial influence on the feel of driver shots.

Like the core of prior art two-piece solid golf balls, the inner sphere 12 may be formed of a rubber material based on polybutadiene which is vulcanized with an organic peroxide with the aid of a crosslinking agent such as zinc (meth) acrylate.

The surrounding layer 13 around the inner sphere 12 preferably has a hardness of at least 45 degrees, especially at least 55 degrees on Shore D. If the surrounding layer's hardness is less than 45 degrees, restitution would be reduced. For providing a better feel, the surrounding layer 13 should preferably have a hardness of up to 80 degrees, especially up to 75 degrees on Shore D. It is preferred that the hardness of the surrounding layer 13 be greater than the hardness of the inner cover layer 15 and that the hardness of the surrounding layer 13 be greater than the hardness of the inner sphere 12 for compensating for the short restitution of the very soft inner sphere 12.

Preferably the surrounding layer 13 has a gauge of 1.0 to 10 mm, especially 1.0 to 8 mm and the core 11 has a diameter of 35 to 41 mm, especially 36 to 40 mm. If the surrounding layer 13 is too thin, restitution would be insufficient. If the surrounding layer 13 is too thick, the hitting feel would be exacerbated.

The surrounding layer 13 may be formed mainly of thermoplastic resins such as ionomer resins or rubber base materials like the inner sphere 12.

In the practice of the invention, the material and preparation of the core are not critical. Any of well-known materials and methods may be used insofar as the abovementioned golf ball properties are achievable.

More particularly, the inner sphere of the core of the golf ball according to the invention may be prepared by a conventional technique while properly adjusting vulcanizing conditions and formulation. Usually the inner sphere is formed of a composition comprising a base rubber, a crosslinking agent, a co-crosslinking agent, and an inert filler. The base rubber may be selected from natural rubber and synthetic rubbers used in conventional solid golf balls. The preferred base rubber is 1,4-polybutadiene having at least 40% of cis-structure. The polybutadiene may be blended with natural rubber, polyisoprene rubber, styrenebutadiene rubber or the like. The crosslinking agent is typically selected from organic peroxides such as dicumyl peroxide and di-t-butyl peroxide, especially dicumyl peroxide. About 0.5 to 1.0 part by weight of the crosslinking agent is blended with 100 parts by weight of the base rubber. The co-crosslinking agent is typically. selected from metal salts of unsaturated fatty acids, inter alia, zinc and magnesium salts of unsaturated fatty acids having 3 to 8 carbon atoms (e.g., acrylic acid and meth-acrylic acid) though not limited thereto. Zinc acrylate is especially preferred.

About 5 to 40 parts by weight of the co-crosslinking agent is blended with 100 parts by weight of the base rubber. Examples of the inert filler include zinc oxide, barium sulfate, silica, calcium carbonate, and zinc carbonate, with zinc oxide and barium sulfate being often used. The amount of the filler blended is preferably about 10 to about 100 parts by weight per 100 parts by weight of the base rubber. In the practice of the invention, the amount of the filler (typically zinc oxide and barium sulfate) is properly selected so as to provide the desired hardness to the inner sphere.

An inner sphere-forming composition is prepared by kneading the above-mentioned components in a conventional mixer such as a Banbury mixer and roll mill, and it is compression or injection molded in an inner sphere mold. The molding is then cured by heating at a sufficient temperature for the crosslinking agent and co-crosslinking agent to function (for example, a temperature of about 130 to 170° C. for a combination of dicumyl peroxide as the crosslinking agent and zinc acrylate as the co-crosslinking agent), obtaining an inner sphere.

Where the solid core consists of an inner sphere and a single surrounding layer, the surrounding layer may be formed of a composition similar to the composition used for the inner sphere or another resin composition based on an ionomer resin or the like. The surrounding layer can be formed on the inner sphere by compression molding or injection molding. Where more than one surrounding layer is included, they may be similarly formed.

The golf ball of the invention is prepared in accordance with the Rules of Golf, that is, to a diameter of at least 42.67 mm and a weight of not greater than 45.93 grams. The golf ball preferably has a distortion or compression of 2.5 mm to 4.0 mm, especially 2.6 to 3.5 mm under a load of 100 kg.

There has been described a multi-piece solid golf ball which will travel a distance comparable to conventional solid golf balls and have spin receptivity approximate to wound golf balls and which is improved in durability and feel.

EXAMPLE

Examples of the present invention are given below by way of illustration and not by way of limitation.

Examples 1-7 & Comparative Examples 1-4

Golf balls as shown in Table 1 were prepared by the following procedure.

Inner Sphere

An inner sphere having a hardness as reported in Table 1 was prepared by milling an inner sphere-forming rubber composition of the formulation shown below in a roll mill 30 and compression molding it in a mold at 155° C. for 15 minutes.

| Formulation | Parts by weight |
|---|---|
| 1,4-polybutadiene (cis structure) | 100 |
| Zinc acrylate | 15-30 |
| Dicumyl peroxide | 0.9 |
| Anti-oxidant | 0.2 |
| Zinc oxide | 5 |
| Barium sulfate | 15-40 |

Surrounding Layer

Some surrounding layers were formed from a rubber base material while the remaining layers were formed from a thermoplastic resin. In the case of a rubber base material, components as used for the inner sphere were milled in a roll mill, molded into half shells in semi-vulcanized state. The inner sphere was enclosed with the half shells, which were compression molded again at 155° C. for 15 minutes, yielding a core (Examples 6 and 7). In the case of a thermoplastic resin, Hytrel 5557, Himilan 1706 or Himilan 1706/1605=50/50 was injection molded over the inner sphere to yield a core (Examples 1 to 5).

Inner Cover Layer

Hytrel 4047, Hytrel 4767 or Hytrel 5612JB was injection molded over the surrounding layer to form an inner cover layer as reported in Table 1.

Outer Cover Layer

A blend of Himilan 1650/Surlyn 8120 was injection molded over the inner cover layer to form an outer cover layer as reported in Table 1.

The golf balls were examined for spin, carry, total distance, and feel by hitting the balls with a driver (#W1) at a head speed (HS) of 45 m/sec. The golf balls were also examined for spin and launch angle by hitting the balls with a sand wedge at a head speed of 19 m/sec. The golf balls were further examined for spin, carry, and total distance by hitting the balls with No. 7 iron at a head speed of 38 m/sec. Using a putter, the golf balls were also examined for putting feel. The results are shown in Table 1.

Three professional golfers who swung at a head speed of 45 to 48 m/sec. actually hit the golf balls to examine their hitting feel. The ball was rated "◎" when it was felt very soft, "O" when soft, "Δ" when a little hard, and "X" when hard.

TABLE 1

| | E1 | E2 | E3 | E4 | E5 | E6 | E7 | CE 1 | CE 2 | CE 3 | CE 4 |
|---|---|---|---|---|---|---|---|---|---|---|---|
| Inner sphere | | | | | | | | | | | Commercially |
| Diameter (mm) | 35.30 | 35.30 | 33.90 | 33.50 | 35.30 | 30.00 | 27.00 | 38.50 | 38.50 | 36.50 | available |
| Shore D | 47 | 45 | 40 | 45 | 45 | 35 | 29 | 45 | 53 | 49 | wound |
| Surrounding layer | | | | | | | | | | | balata |
| Diameter (mm) | 37.90 | 37.90 | 37.90 | 36.10 | 37.90 | 37.90 | 37.70 | — | — | — | ball |
| Shore D | 68 | 73 | 68 | 68 | 68 | 65 | 65 | — | — | — | |
| Inner cover layer | | | | | | | | | | | |
| Gage (mm) | 1.25 | 1.25 | 1.25 | 1.50 | 1.25 | 1.00 | 1.50 | — | — | 1.60 | |
| Shore D | 40 | 45 | 40 | 40 | 35 | 40 | 35 | — | — | 68 | |
| Outer cover layer | | | | | | | | | | | |
| Gage (mm) | 1.15 | 1.15 | 1.15 | 1.80 | 1.15 | 1.40 | 1.00 | 2.10 | 2.10 | 1.50 | |
| Shore D | 47 | 51 | 51 | 55 | 47 | 53 | 43 | 65 | 53 | 55 | |

TABLE 1-continued

| | E1 | E2 | E3 | E4 | E5 | E6 | E7 | CE 1 | CE 2 | CE 3 | CE 4 |
|---|---|---|---|---|---|---|---|---|---|---|---|
| Ball | | | | | | | | | | | |
| Diameter (mm) | 42.70 | 42.70 | 42.70 | 42.70 | 42.70 | 42.70 | 42.70 | 42.70 | 42.70 | 42.70 | |
| Hardness* | 2.90 | 2.85 | 3.10 | 2.80 | 3.20 | 2.75 | 2.85 | 2.80 | 2.40 | 2.40 | |
| #W1/HS45 | | | | | | | | | | | |
| Spin (rpm) | 2980 | 2870 | 2810 | 2920 | 3010 | 2790 | 2880 | 2690 | 2850 | 2870 | 3255 |
| Carry (m) | 210.8 | 211.3 | 210.2 | 210.6 | 210.7 | 211.1 | 210.8 | 208.2 | 208.7 | 210.3 | 207.9 |
| Total (m) | 224.6 | 225.3 | 224.3 | 224.5 | 224.2 | 225.5 | 224.8 | 223.1 | 223.5 | 224.3 | 221.6 |
| Feel | ○ | ○ | ◎ | ○ | ○ | ◎ | ◎ | ○ | X | ○ | ◎ |
| #SW/HS19 | | | | | | | | | | | |
| Spin (rpm) | 6020 | 5770 | 5810 | 5580 | 6080 | 5760 | 6160 | 4130 | 5670 | 5920 | 6070 |
| Launch angle (°) | 30.0 | 30.6 | 30.4 | 31.1 | 29.8 | 30.6 | 29.6 | 34.3 | 30.8 | 30.2 | 29.8 |
| #I7/HS38 | | | | | | | | | | | |
| Spin (rpm) | 6450 | 6370 | 6300 | 6280 | 6350 | 6400 | 6500 | 5200 | 5450 | 5340 | 6450 |
| Carry (m) | 151.4 | 151.8 | 151.9 | 152.0 | 151.6 | 151.9 | 151.0 | 156.7 | 156.0 | 156.0 | 151.2 |
| Total (m) | 151.6 | 152.0 | 152.5 | 152.5 | 152.0 | 152.1 | 151.0 | 160.2 | 159.1 | 160.0 | 151.5 |
| Putt | | | | | | | | | | | |
| Feel | ◎ | ○ | ○ | ○ | ◎ | ○ | ◎ | X | Δ | X | ○ |

*a distortion (mm) under a load of 100 kg

Although some preferred embodiments have been described, many modifications and variations may be made thereto in the light of the above teachings. It is therefore to be understood that within the scope of the appended claims, the invention may be practiced otherwise than as specifically described.

The invention claimed is:

1. A multi-piece solid golf ball having a structure of at least four layers, said ball comprising a core having a structure consisting of at least two layers and a cover enclosing the core and consisting of inner and outer cover layers, said outer cover layer having a hardness of 40 to 60 degrees on Shore D, and said inner cover layer having a hardness of up to 53 degrees on Shore D and lower than that of said outer cover layer.

2. The golf ball of claim 1 wherein said inner cover layer is softer than said outer cover layer by a hardness difference of at least 5 degrees on Shore D.

3. The golf ball of claim 1 wherein said outer cover layer has a gage of 0.5 to 3.0 mm, said inner cover layer has a gage of 0.5 to 3.0 mm, and the entire cover has a gage of 1.0 to 5.0 mm.

4. The golf ball of claim 1 wherein said core consists of an inner sphere and a layer surrounding the inner sphere, said inner sphere has a diameter of 20 to 39 mm and is formed of a rubber base material to a hardness of 20 to 55 degrees on Shore D, said surrounding layer has a hardness of at least 45 degrees on Shore D, and said core has a diameter of 35 to 41 mm.

5. A multi-piece solid golf ball having a structure of at least four layers, said ball comprising; a core having a structure consisting of an inner sphere and a layer surrounding the inner sphere and a cover enclosing the core and consisting of inner and outer cover layers, said outer cover layer having a hardness of 40 to 60 degrees on Shore D, and said inner cover layer having a hardness of up to 53 degrees on Shore D and lower than that of said outer cover layer, said core having a diameter of 35 to 41 mm, and said surrounding layer having a hardness of at least 45 degrees on Shore D.

6. The golf ball of claim 5 wherein said inner cover layer is softer than said outer cover layer by a hardness difference of at least 5 degrees on Shore D.

7. The golf ball of claim 5 where said outer cover layer has a gage of 0.5 to 3.0 mm, said inner cover layer has a gage of 0.5 to 3.0 mm, and the entire cover has a gage of 1.0 to 5.0 mm.

8. The golf ball of claim 5 wherein said inner sphere has a diameter of 20 to 39 mm and is formed of a rubber base material.

9. A multi-piece solid golf ball having a structure of at least four layers, said ball comprising; a core having a structure consisting of an inner sphere and a layer surrounding the inner sphere and a cover enclosing the core and consisting of inner and outer cover layers, said outer cover layer having a hardness of 40 to 60 degrees on Shore D, said inner cover layer having a hardness of up to 53 degree on Shore D and lower than that of said outer cover layer, and said inner sphere having a lower hardness than said surrounding layer.

10. The golf ball of claim 9 wherein said inner cover layer is softer than said outer cover layer by a hardness difference of at least 5 degrees on Shore D.

11. The golf ball of claim 9 wherein said outer cover layer has a gage of 0.5 to 3.0 mm, said inner cover layer has a gage of 0.5 to 3.0 mm, and the entire cover has a gage of 1.0 to 5.0 mm.

12. The golf ball of claim 9 wherein said inner sphere has a diameter of 20 to 39 mm and is formed of a rubber base material, said surrounding layer has a hardness of at least 45 degrees on Shore D, and said core has a diameter of 35 to 41 mm.

13. The golf ball of claim 1, wherein the thickness of said inner cover layer is from 1.00 to 1.50 mm.

14. The golf ball of claim 5, wherein the thickness of said inner cover layer is from 1.00 to 1.50 mm.

15. The golf ball of claim 9, wherein the thickness of said inner cover layer is from 1.00 to 1.50 mm.

16. The golf ball of claim 1, wherein said inner cover layer is softer than said outer cover layer by a hardness difference of at least 7 degrees on Shore D.

17. The golf ball of claim 5, wherein said inner cover layer is softer than said outer cover layer by a hardness difference of at least 7 degrees on Shore D.

18. The golf ball of claim 9, wherein said inner cover layer is softer than said outer cover layer by a hardness difference of at least 7 degrees on Shore D.

19. The golf ball of claim 1, wherein said inner cover layer is softer than said outer cover layer by a hardness difference of at least 8 degrees on Shore D.

20. The golf ball of claim 5, wherein said inner cover layer is softer than said outer cover layer by a hardness difference of at least 8 degrees on Shore D.

21. The golf ball of claim 9 wherein said inner cover layer is softer than said outer cover layer by a hardness difference of at least 8 degrees on Shore D.

* * * * *